US005148688A

United States Patent [19]

Pimm et al.

[11] Patent Number: 5,148,688

[45] Date of Patent: Sep. 22, 1992

[54] DRINKING VESSEL

[76] Inventors: Annette R. Pimm; Jacob H. Fonda, both of 4085 Rte. 247, Gorham, N.Y. 14424

[21] Appl. No.: 733,462

[22] Filed: Jul. 22, 1991

[51] Int. Cl.[5] ..... F25D 3/08

[52] U.S. Cl. ..... 62/457.3; 126/261; 126/262

[58] Field of Search ..... 62/457.3, 457.1, 529; 126/271.3, 262, 263, 261, 389

[56] References Cited

U.S. PATENT DOCUMENTS

| | | | |
|---|---|---|---|
| 1,979,222 | 10/1934 | Goodwin | 126/261 |
| 2,075,137 | 3/1937 | Rosen | 62/457.3 |
| 2,187,558 | 1/1940 | Kushima | 62/457.3 |
| 2,893,376 | 7/1959 | Pasqua | 126/261 |
| 3,359,756 | 12/1967 | Mirquet | 62/457.1 |
| 3,726,106 | 4/1973 | Jaeger | 126/262 |
| 4,481,792 | 11/1984 | Groeger et al. | 62/457.5 |
| 4,570,454 | 2/1986 | Campbell | 62/457.3 |
| 4,597,435 | 7/1986 | Fosco, Jr. | 126/261 |
| 4,834,065 | 5/1989 | McQuade | 126/262 |

*Primary Examiner*—Albert J. Makay
*Assistant Examiner*—William C. Doerrler
*Attorney, Agent, or Firm*—Robert J. Bird

[57] ABSTRACT

A drinking vessel with an ice container mountable within the vessel to cool the vessel contents without diluting it, and a heat chamber for burning fuel to heat the vessel contents. The ice container is removably mounted in the vessel by magnetic members, or by snap engaging members, or by mating threads on the vessel and the container.

13 Claims, 2 Drawing Sheets

DRINKING VESSEL

BACKGROUND INFORMATION

This invention is a self-contained drinking vessel with provision for cooling and for heating the vessel contents, as desired.

Ice cubes are commonly used to make beverages cold for consumption. Dilution of the beverage by melting ice necessarily results. This is acceptable for some drinks, but not for others. Beer drinkers, for example, generally do not put ice cubes in a glass of beer. Insulated vessels of thick glass, plastic, or styrofoam, for example, are commonly used to keep drinks cool without ice. These are more or less effective to retard heat transfer through the vessel wall and into the liquid, but they only insulate; they do not provide positive cooling.

The only prior art that we know which is relevant to the cooling aspect of this invention is a decanter with a lid and a removable ice container attached to the lid. The ice container is suspended from the lid into the decanter and its contents. The decanter can be used only for pouring, and not for drinking because the lid and ice container are in the way. Furthermore, the ice container hangs down into the liquid, but not to the bottom of the decanter, and therefore does not directly cool the bottom liquid.

Adding heat to the contents of the vessel is the other subject of this invention. The nearest thing we know of to a self-contained vessel for heating liquids is a vessel with an integral electric coil requiring attachment to a power supply.

SUMMARY OF THE INVENTION

The present invention is a drinking vessel with an ice container mountable within the vessel to cool the vessel contents without diluting it, and a heat chamber for burning fuel to heat the vessel contents. The ice container is removably mounted in the vessel by magnetic members, or by snap engaging members, or by mating threads on the vessel and the container.

DRAWING

DESCRIPTION

Figure 1:
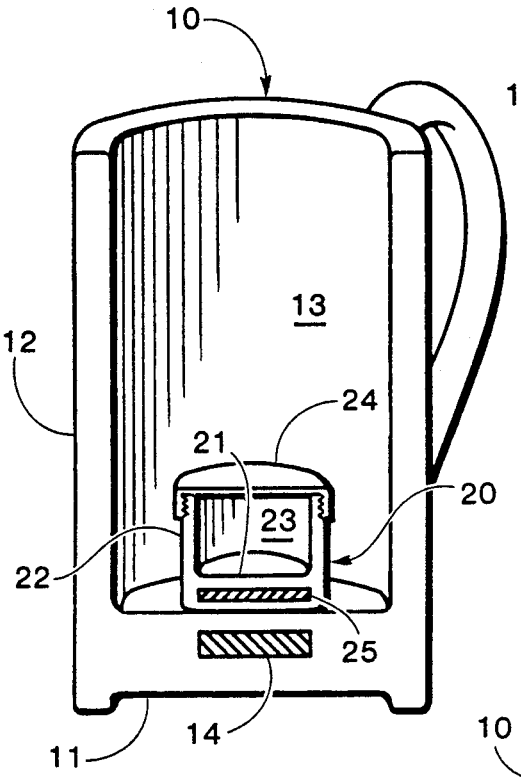
FIG. 1 is an elevation view of a combination liquid vessel and ice container according to this invention.

It will avoid a confusion of section lines in the drawing if the vessel and container are considered as made of a transparent material. Glass or clear plastic may indeed be used, but materials per se are not an essential feature of the invention.

Figure 2:
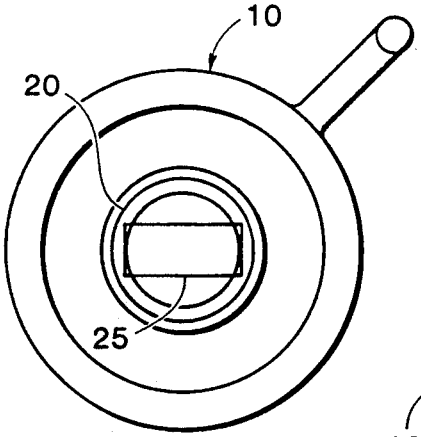
FIG. 2 is a top view of the vessel and container of FIG. 1.

FIGS. 1 and 2 show a vessel 10 including a bottom 11 and sidewalls 12 forming a liquid cavity 13. A magnetic member 14 is embedded in the bottom 11. The vessel 10 is preferably insulated in one form or another.

An ice container 20 includes a bottom 21 and sidewalls 22 forming an ice chamber 23, and a removable liquid tight cover 24. A magnetic member 25 is embedded in the bottom 21, or otherwise fixed to it, or simply placed in the ice container 20.

Figure 3:
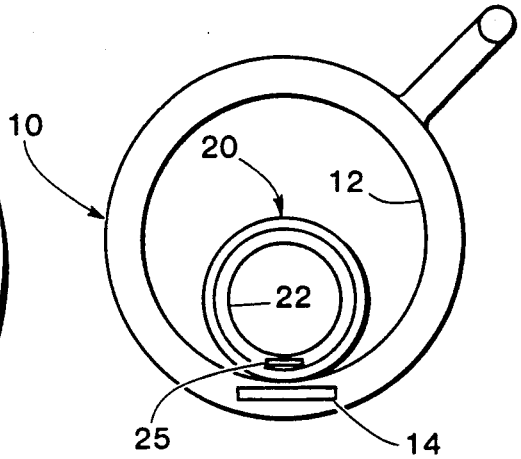
FIG. 3 is a top view of another form of the vessel and container.

FIG. 3 shows a variation of the device of FIGS. 1 and 2, in which the magnetic member 14 is embedded in the vessel sidewall 12 and the magnetic member 25 is embedded in the container sidewall 22.

In either case, whether they are in the respective bottoms or sidewalls, the magnetic members 14 and 25 are positioned so that they face each other to hold the ice container in place within the vesssel. The magnetic attachment of the ice container to the vessel is such that it can easily be broken by hand to remove the ice container from the vessel.

Figure 4:
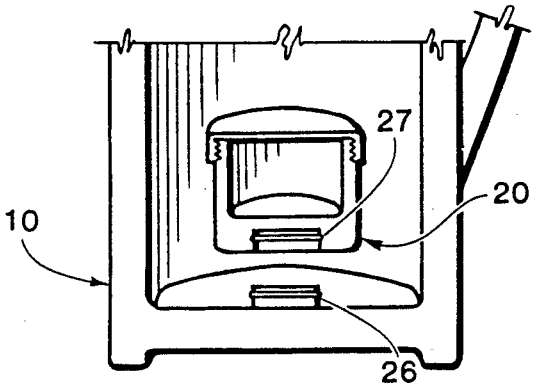
FIG. 4 is a partial view of another form of the invention.
Figure 5:
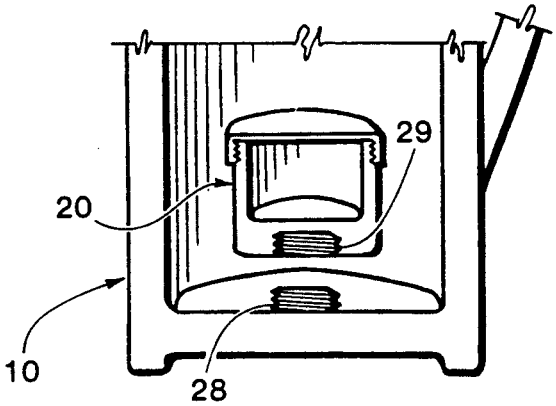
FIG. 5 is a partial view of another form of the invention.

The ice container 20 might be removably attached to the bottom of the vessel 10 by other means, such as a snap engagement of mating male and female members 26 and 27, as shown in FIG. 4, or by engagement of male and female threads 28 and 29, as shown in FIG. 5.

In use, the ice container 20 is filled with ice, closed, and mounted in the vessel 10 by magnetic attachment, snap fit, or threaded engagement. Liquid poured into the vessel, over the ice container, is made cold or kept cold by contact with the ice container. The ice in the container 20 provides positive cooling of liquid in the vessel 10 without diluting it. The insulated vessel of course retards heat transfer into the system, as in the prior art.

Figure 6:
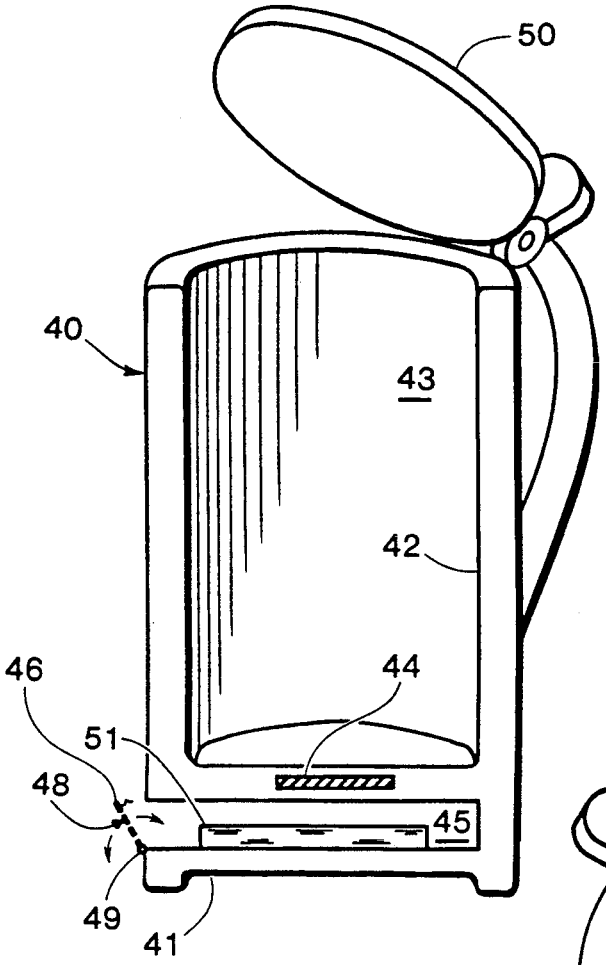
FIG. 6 is a front elevation view of another form of the invention with further provision for heating the vessel contents.
Figure 7:
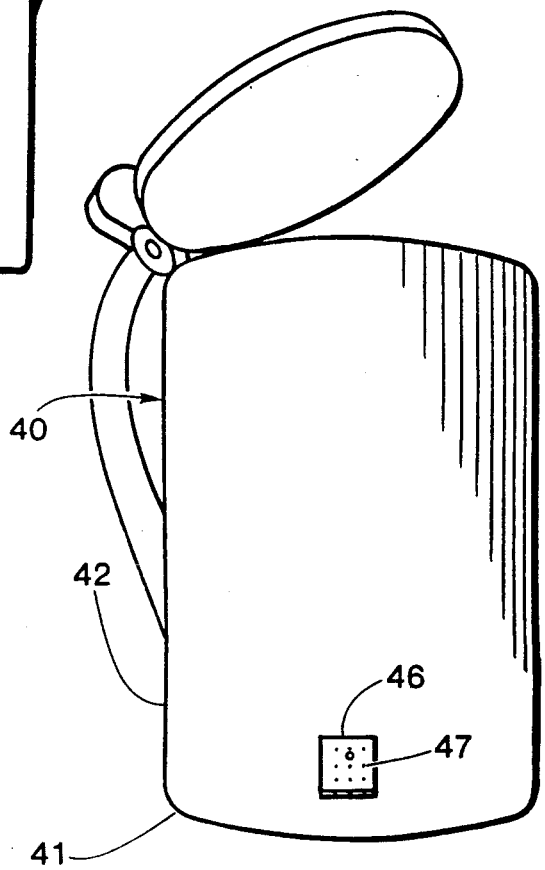
FIG. 7 is a side elevation view from the left of FIG. 6.

FIGS. 6 and 7 show a vessel 40 including a base or bottom 41 and sidewalls 42 forming a liquid cavity 43. A magnetic member 44 is embedded in the base 41. The base 41 also includes an elongated heat chamber 45 extending diametrically partially through the base. A door 46 with several air holes 47 is adapted for opening and closing over the open end of the heat chamber 45 on a hinge 49. A door knob 48 is an example of means to open, close, and secure the door 46. The vessel 40 includes a lid 50 to help retain heat in the contents. A fuel stick 51 is placed in the heat chamber. The fuel stick burns to heat the vessel contents. In this embodiment of the invention, the vessel is made of thin stainless steel, or brass, or a high temperature plastic. The heat chamber is made or lined with spun glass, or a vermiculite, or a high temperature material.

The ice container 20 of FIGS. 1 and 2, though not shown in FIGS. 6 and 7, is intended as part of the combination, and the vessel 40 includes a magnetic member 44 for the purpose of mounting an ice container. The several variations of FIGS. 3, 4, and 5 for mounting an ice container within the vessel 10 are also contemplated for the vessel 40.

As is well known, two magnets will adhere to each other, and a single magnet will adhere to ordinary iron, steel, and other ferromagnetic metals or materials. In the following claims, the term "magnetic members" is intended to include all the working combinations of two magnets or one magnet and one ferromagnetic plate.

The foregoing description of a preferred embodiment of this invention, including any dimensions, angles, or proportions, is intended as illustrative. The concept and scope of the invention are limited only by the following claims and equivalents thereof.

What is claimed is:

1. The combination of:

a drinking vessel including a bottom and sidewalls defining a vessel interior to contain liquid;

a separate ice container including a bottom, sidewalls, and a removable liquid-tight cover openable into said vessel interior; and mounting means to releasably mount said ice container within said vessel in a standing position on the bottom thereof, for immersion in said liquid;

whereby ice in said container provides positive cooling of liquid in said vessel without diluting said liquid.

2. The combination drinking vessel and ice container as defined in claim 1, in which said mounting means includes cooperating magnetic members disposed on said vessel and said container.

3. The combination drinking vessel and ice container as defined in claim 1, in which said mounting means includes mating snap engaging members on said vessel and said container.

4. The combination drinking vessel and ice container as defined in claim 1, in which said mounting means includes mating threads on said vessel and said container.

5. The combination of:

a drinking vessel including a bottom and sidewalls defining a vessel interior to contain liquid, and a first magnetic member disposed on said vessel;

a separate ice container including a bottom and sidewalls removably mounted within said vessel, liquid-tight closure means to open and close said ice container relative to said vessel interior, and a second magnetic member disposed on said container;

said first and second magnetic members cooperating to releasably mount said ice container within said vessel interior in a standing position on the bottom thereof for immersion in said liquid;

whereby ice in said container provides positive cooling of liquid in said vessel without diluting said liquid.

6. The combination drinking vessel and ice container as defined in claim 5, in which said magnetic members are disposed on the bottoms of said vessel and said container.

7. The combination drinking vessel and ice container as defined in claim 5, in which said magnetic members are disposed on the sidewalls of said vessel and said container.

8. The combination of:

a drinking vessel including a base and sidewalls defining a vessel interior to contain liquid;

a separate ice container including a bottom, sidewalls, and a removable liquid-tight cover openable into said vessel interior;

mounting means to releasably mount said ice container within said vessel in a standing position on the bottom thereof for immersion in said liquid:

a combustion chamber within said base; and means to open and close said combustion chamber for placement of fuel therein, and to secure and ventillate said heat chamber for combustion of said fuel therein;

whereby ice in said container provides positive cooling of liquid in said vessel without diluting said liquid, and combustion in said combustion chamber is effective to heat liquid in said vessel.

9. The combination drinking vessel and ice container as defined in claim 8, in which said mounting means includes cooperating magnetic members disposed on said vessel and said container.

10. The combination drinking vessel and ice container as defined in claim 9, in which said magnetic members are disposed on the bottoms of said vessel and said container.

11. The combination drinking vessel and ice container as defined claim 9, in which said magnetic members are disposed on the sidewalls of said vessel and said container.

12. The combination drinking vessel and ice container as defined in claim 8, in which said mounting means includes mating snap engaging members on said vessel and said container.

13. The combination drinking vessel and ice container as defined in claim 8, in which said mounting means includes mating threads on said vessel and said container.

* * * * *